US006283059B1

(12) United States Patent
Scully, Jr.

(10) Patent No.: US 6,283,059 B1
(45) Date of Patent: Sep. 4, 2001

(54) CONVERTIBLE SEAT AND DECK APPARATUS

(76) Inventor: Elwood J. Scully, Jr., 1015 Stephensville Rd., Morgan City, LA (US) 70380

( * ) Notice: Subject to any disclaimer, the term of this patent is extended or adjusted under 35 U.S.C. 154(b) by 0 days.

(21) Appl. No.: 09/391,778

(22) Filed: Sep. 8, 1999

(51) Int. Cl.[7] ..... B63B 29/04
(52) U.S. Cl. ..... 114/363; 297/118; 297/125
(58) Field of Search ..... 297/14, 15, 62, 297/112, 118, 125, 283.3, 378.11; 114/85, 363; 296/65.01, 65.16

(56) References Cited

U.S. PATENT DOCUMENTS 591,095 * 10/1897 Evans ..... 297/62
1,255,764 * 2/1918 Macon ..... 297/125
1,471,007 * 10/1923 Schmidt ..... 297/188.1 X
1,888,263 * 11/1932 Geiger ..... 297/188.1 X
2,229,608 * 1/1941 Ragsdale et al. ..... 297/62
2,383,178 * 8/1945 Edwards ..... 114/363
3,475,773 * 11/1969 Codman, Jr ..... 114/363 X
4,266,441 5/1981 Stordeur .
4,473,250 9/1984 Truex et al. .
4,738,217 4/1988 Smith .
4,934,303 6/1990 Lathers et al. .

* cited by examiner

*Primary Examiner*—Peter R. Brown
(74) *Attorney, Agent, or Firm*—Domingue & Waddell, PLC

(57) ABSTRACT

A convertible seat and deck apparatus includes a frame having a first guide wall and a second guide wall. The first guide wall has a first elongated slot and a second elongated slot. The second guide wall has a third elongated slot and a fourth elongated slot. A seat back has a first seating surface, an opposite second deck surface, a first side and a second side. A first guide pin and a second guide pin project from the first side. A third guide pin and a fourth guide pin project from the second side. The seat back is moveable with respect to the frame between a first seating position and a second deck position.

13 Claims, 5 Drawing Sheets

CONVERTIBLE SEAT AND DECK APPARATUS

BACKGROUND OF THE INVENTION

1. Field of the Invention

The present invention relates to a convertible seat and deck apparatus. More specifically, the present invention relates to an apparatus on a marine vessel that may be converted between being a deck and being a seat.

2. Discussion of the Related Art

It is well known in the field of transportation, and particularly in the boat industry, to provide combination seating and storage or seating and bed systems. An advantage of these systems is the efficient use of the limited space available aboard boats. In seating and storage systems, a separable lid is placed over a container. The lid also serves as an occupant support surface. Often, these lids have been upholstered to increase the comfort for a passenger. Additionally, it is well known to hinge the storage compartment lid from the rear ledge of the lid to allow the lid to pivot about its rearward edge and ultimately rest against a back rest of the seating/storage compartment.

In the seating and bed systems, the seat back is pivotable with respect to the seat base so that the seat back can pivot between a first position where it forms the back of seat and a second position where it is substantially coplanar with the seat base, thereby forming a bed.

In marine vessels that are used for fishing, the bow and stern portions of the boat are often provided with raised decks so that a fisherman can stand on these decks while fishing. Fishing boats often have a large amount of open space so that the fisherman is free to travel between the deck at the bow of the boat and the deck at the stern of the boat. Usually, the only impediment to the fisherman is one or two seats for the operator of the boat to use while driving the boat to, from and about the fishing grounds. But one frequently fishes with more than two people. Therefore, while traveling to, from and about the fishing grounds it is desirous to provide additional seating for these additional passengers.

Accordingly, there is a need in the art for a marine vessel that includes a deck that can be converted into a seating apparatus. The deck can be used, for instance, as a platform for fishing or a platform for bedding. There is a further need in the art to maintain the position for the convertible seat/deck apparatus in either the deck or seat position so that the deck will not inadvertently move to the seat position and the seat will not inadvertently move to the deck position. Moreover, there is a need for a convertible seat and deck apparatus that takes up a minimum amount of space on a vessel.

SUMMARY OF THE INVENTION

According to an exemplary embodiment of a convertible seat and deck apparatus according to the present invention these and other objects are achieved with a frame that has a first guide wall. The first guide wall has a first elongated slot and a second elongated slot. A seat back has a first seating surface, an opposite second deck surface and a first side. A first guide pin projects from the first side. A second guide pin projects from the first side. The first guide pin is slidably received in the first elongated slot. The second guide pin is slidably received in the second elongated slot. The seat back is movable with respect to the frame between a first seating position and a second deck position.

According to a further exemplary embodiment of the present invention, these and other objects are achieved with a frame having a first guide wall and a second guide wall. The first guide wall has a first elongated slot and a second elongated slot. The second guide wall has a third elongated slot and a fourth elongated slot. A seat back has a first seating surface, an opposite second deck surface, a first side and a second side. A first guide pin and a second guide pin project from the first side. A third guide pin and a fourth guide pin project from the second side. The seat back is moveable with respect to the frame between a first seating position and a second deck position.

A locking mechanism may also be provided that locks the seat back in either the deck position or the seating position. The locking mechanism may comprise a hook member having a lever attached thereto. In the preferred embodiment, two hook members are pivotally attached to each guide wall and are configured to selectively engage the guide pins. A bushing may also be disposed about the guide pin, with bushing acting to reduce friction and lubricate the guide pins within the slots.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
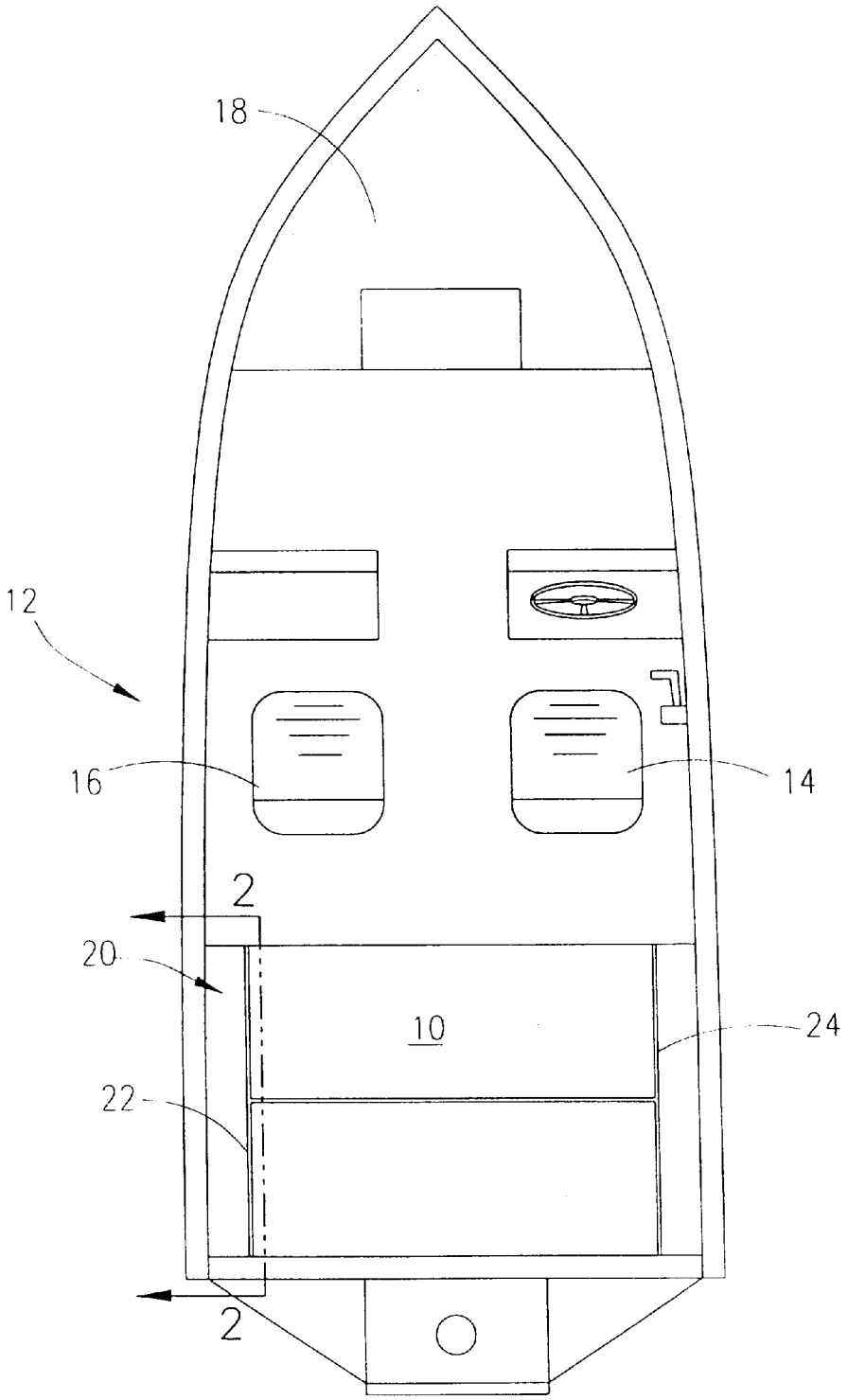
FIG. 1 is a top plan view of a marine vessel according to the present invention.

Referring now to FIGS. 1–9, a convertible seat and deck apparatus 10 in accordance with the present invention is illustrated. FIG. I illustrates a top plan view of an exemplary marine vessel 12, which is typically used as a fishing boat. Fishing boats typically include a first captain's chair 14 and a second captain's chair 16. Boat 12 also includes a deck 18 positioned at the bow of the boat and a convertible seat/deck 10 positioned at the stern of the boat. Of course, the convertible seat/deck apparatus may be positioned at any desirable location within the boat and it is being shown at the stern of the boat for illustrative purposes only.

Figure 2:
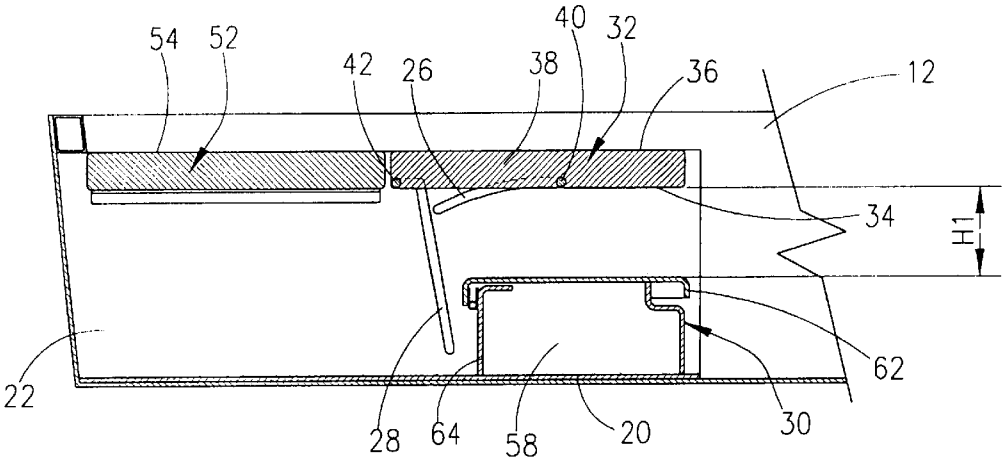
FIG. 2 is a side view of the convertible seat/deck apparatus according to the present invention, shown in the second deck position.
Figure 3:
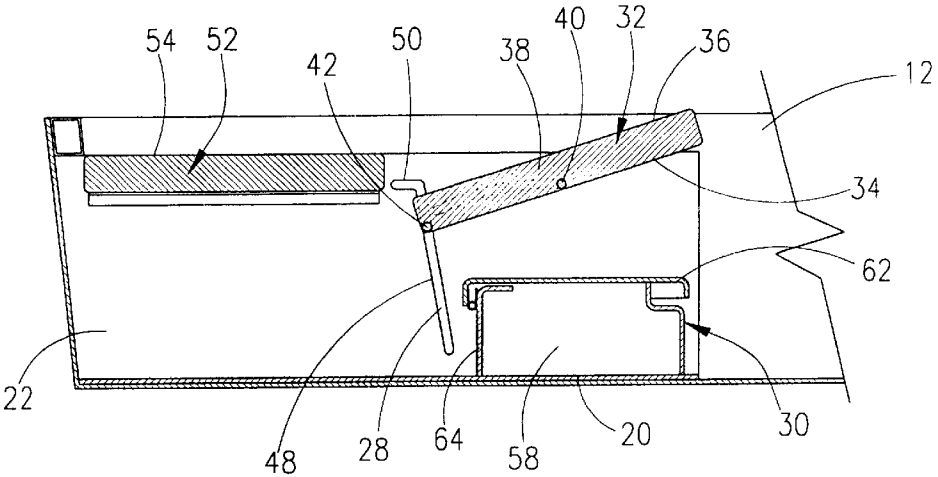
FIG. 3 is a side view of the convertible seat/deck apparatus in a position between the first seating position and the second seating deck position.
Figure 4:
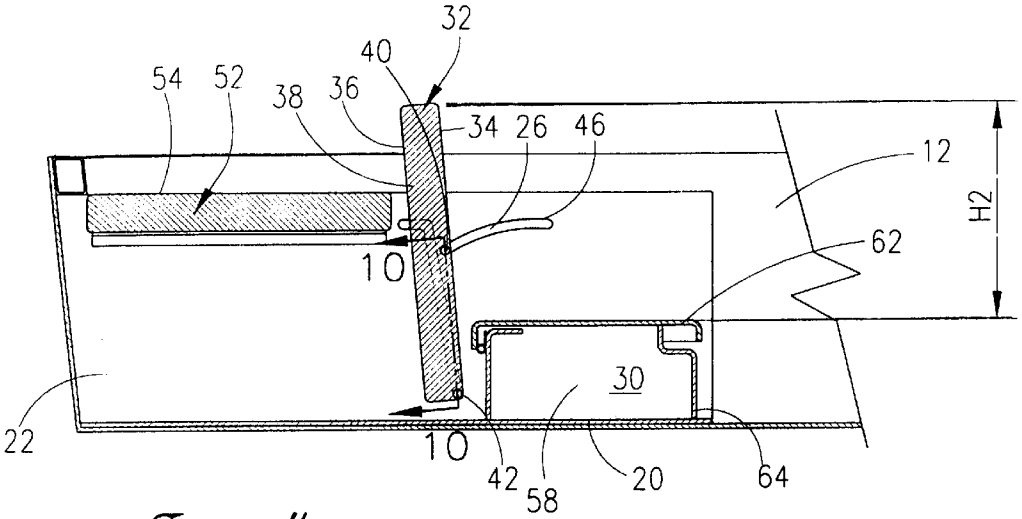
FIG. 4 is a side view of the convertible seat/deck apparatus, shown in the first seating position.
Figure 5:
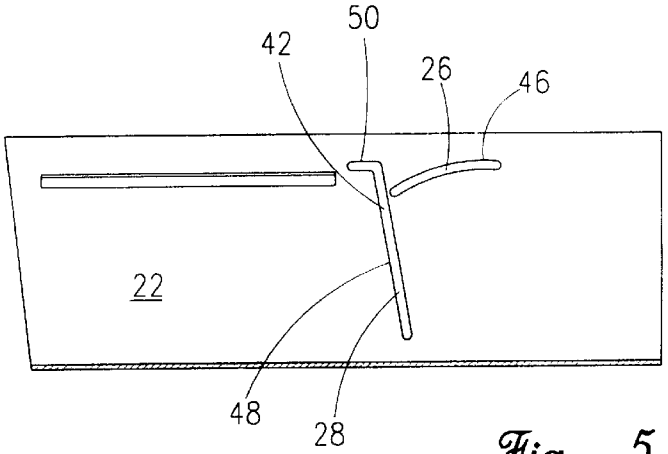
FIG. 5 is a side view of the guide wall.

Referring now to FIGS. 2–5, the convertible seat/deck apparatus 10 includes a frame 20. It should be noted that like numbers appearing in the various figures refer to like components. Frame 20 includes a first guide wall 22 and a second guide wall 24. Guide walls 22, 24 each have a first elongated guide slot 26 and a second elongated guide slot 28. The convertible seat and deck includes a seat base 30 and a seat back 32. Seat back 32 has a first seating surface 34, an opposite deck surface 36, a first side 38 and an opposite second side, which is not visible in FIGS. 2–4. A first guide pin 40 and a second guide pin 42 projects from first side 38. Similarly, a third guide pin and a forth guide pin project from the opposite second side of seat back 32. Seat back 32 is movable with respect to frame 20 between a first seating position, as shown in FIG. 4, and a second deck position, as shown in FIG. 2.

As illustrated in FIGS. 2–4, first guide slot 26 is substantially curvilinear, but has an essentially linear portion 46. Essentially linear portion 46 supports guide pin 40 when seat back 32 is in the second deck position of FIG. 2. Essentially linear portion 46 is approximately parallel to second deck surface 36, when seat back 32 is in the second deck position.

Second elongated slot 28 is comprised of a first linear portion 48 and a second linear portion 50. First linear portion 48 and second linear portion 50 enclose an angle alpha that ranges from about 85 degrees to 115 degrees and is preferably about 100°. As illustrated, first linear portion 48 is substantially longer than second linear portion 50. Second linear portion 50 is approximately parallel to essentially linear portion 46 and second deck surface 36 when seat back 32 is in the second deck position. This second linear portion 50 can serve as a ledge for the placing and the securing of guide pins when the back seat is in the deck (essentially horizontal) position such as seen in FIG. 2.

The convertible seating and deck apparatus also includes a deck 52 that has a first upper or outwardly facing surface 54. In the second deck position of FIG. 2, deck surface 36 of seat back 32 is coplanar with respect to first surface 54 of deck 52. Deck 52 is fixedly connected to frame 20. Additionally, deck 52 is disposed adjacent to seat back 32 (see FIG. 2). Note also that a distance (H1) is shown which is the unobstructed height that is available to store, for instance, the seat cushions. This height HI is not available with prior art systems including hinged and/or chained means for folding and unfolding platforms.

Second linear portion 50 of elongated slot 48 has a length sufficient to permit seat back 32 to move away from deck 52 so that seat back 32 can then be pivoted and slid to the seating position without interfering with deck 52 as illustrated in FIGS. 3 and 4. More specifically, as illustrated in FIG. 2, pin 42 is disposed at the end of linear portion 50 of track 28 that is disposed adjacent to deck 52. In other words, were seat back 32 to be pivoted directly to the seating position of FIG. 4 from the position illustrated in FIG. 2 without first being moved away from deck 52, a portion of seat back 32 would abut against deck 52. Thus, to move deck 32 from the deck position illustrated in FIG. 2 to the seating position illustrated in FIG. 4, deck 32 must first be moved in a direction indicated by arrow A in FIG. 2 which is forward and 5 towards the bow of the vessel 12.

In the deck position, pin 40 is not disposed at the end of slot 26 that is remote from deck 52, but is spaced a predetermined distance from this end of slot 26. This predetermined distance is approximately equal to the length of second linear portion 50 of slot 28. Thus, when seat back 32 is moved in the direction indicated by arrow A, pin 40 slides to the end of slot 26 that is remote from deck 52. Simultaneously, pin 42 slides into the junction between first linear portion 48 and second linear portion 50 of slot 28. A passenger may then lift seat 32 in the direction indicated by arrow B in FIG. 3 wherein seat back end 33 is in effect lifted upward, which causes seat 32 to initially pivot about guide pin 40, thereby causing guide pin 42 to slide down first linear portion 48 of guide slot 28. Guide slot 28 is sufficiently wide in this portion of first linear portion 48 to permit this pivoting movement of seat 32. From the position illustrated in FIG. 3, continued lifting of seat back 32 causes guide pin 40 to travel along guide slot 26 and guide pin 42 to travel downwardly in first linear portion 48 of guide slot 28 to the seating position illustrated in FIG. 4.

As discussed above, second linear portion 50 of guide slot 28 is approximately parallel to essentially linear portion 46 of guide slot 26 and to deck surface 36 of seat back 32 when in the deck position. Therefore, the lower portion of second linear portion 50 of guide slot 28 also supports seat back 32 when seat back 32 is in the second deck position of FIG. 2. Of course, seat back 32 may be provided with a conventional locking mechanism as will be described later in order to prevent the seat back from being inadvertently moved from the second deck position illustrated in FIG. 2.

As illustrated in FIGS. 2–4, a seat base 30 is connected to frame 20. In the first seating position of FIG. 4, seat base 30 is disposed adjacent to and at an angle with respect to seat back 32. In the second deck position of FIG. 2, seat base 30 is spaced from and is approximately parallel with respect to seat back 32. Note also that in FIG. 4, the height (H2) of the seat back end 33 relative to the seat base 30 is shown. With prior art hinged and/or chained systems, the height of the seat back end relative to the seat base would be significantly higher.

Figure 6:
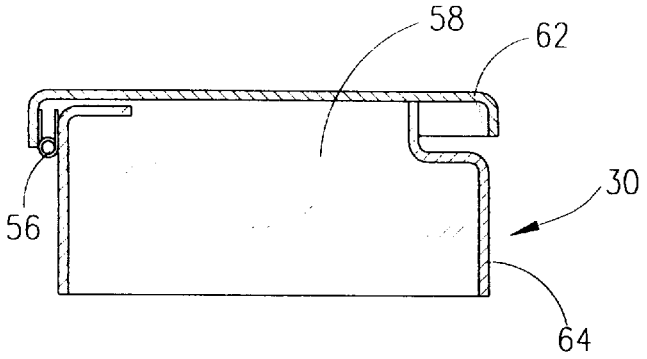
FIG. 6 is a cross-sectional side view of the seat.
Figure 7:
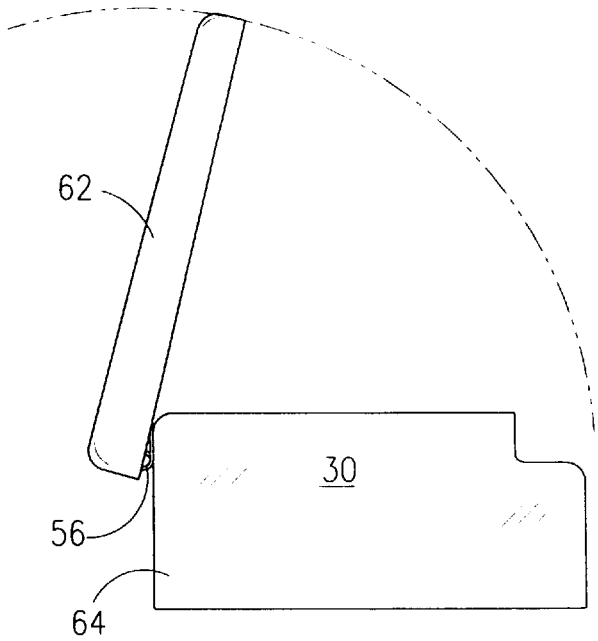
FIG. 7 is a side view of the seat shown with the seat base being pivoted to the storage access position.

Referring now to FIGS. 6 and 7, the top side 62 of seat base 30 is pivotally connected to frame 20 by a pivot pin 56. The sides 64 are extend vertically upward from the frame 20. Thus, when lid top 62 is pivoted to the position illustrated in FIG. 7, an enclosure or storage area 58 can be accessed.

Figure 8:
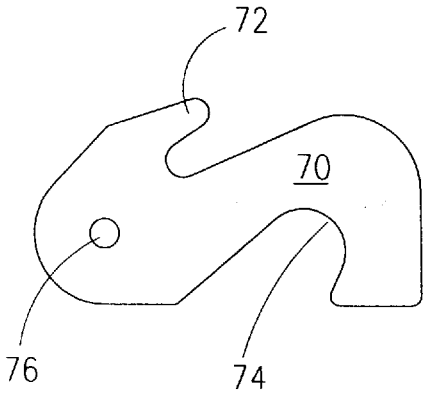
FIG. 8 is a side view of the convertible seat/deck apparatus of FIG. 2 depicting the locking mechanism of the present invention.

A locking means 70 for locking the seat and/or deck in place is shown in FIG. 8. The locking means 70 is generally in the shape of an "S" member and contains the lever 72 that in turn will extend to the hook area 74. The hook area 74 is configured to receive the guide pins 40,42. The locking means 70 contains the aperture 76 for placement of a pin, with the pin being connectable to the side walls. Thus, the operator may rotate the locking means 70 into placement about the guide pin 42 by manipulation of the lever 72 about the pivot point 76.

Figure 9:
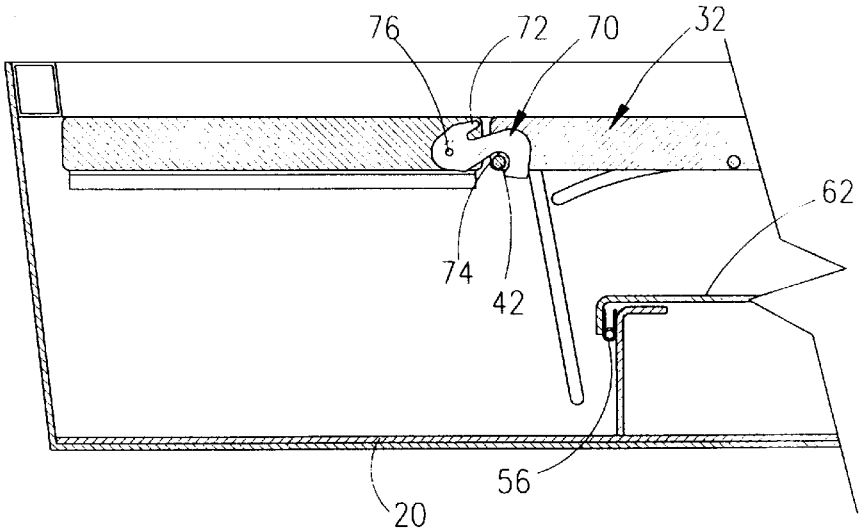
FIG. 9 is a front view of the locking mechanism of FIG. 8.

Referring now to FIG. 9, a side view of the convertible seat/deck apparatus along with the locking means 70 is shown. Thus, the hook area 74 has been placed over the guide pin 42 via the operator's manipulation of lever 72. The seat back 32 will then be locked into place. For instance, vibration would shift the guide pin 42 from ledge 50, locking means 70 would prevent movement of the seat back. In order to unlock, the operator would simply rotate lever 72 so that the hook area 74 is no longer surrounding the guide pin 32. Additionally, it is possible to also provide for locking the seat back 32 into place when the seat back 32 is in the seating (essentially vertical) position as seen in FIG. 4 using the locking means 70 by rotation about the guide pin 42.

Figure 10:
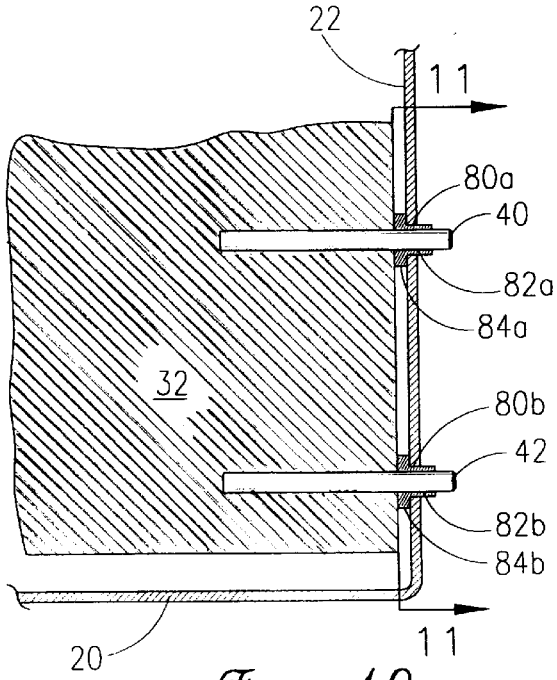
FIG. 10 is a cross-sectional view of the guide pins within the elongated slots.

FIG. 10 depicts a cross-sectional view of the guide pins 40,42. As noted earlier, the guide pins 40,42 are disposed within the seat back 32. A pair of bushings 80*a*, 80*b* are included. These bushing may be constructed of a nylon, and in the preferred embodiment a nylatron material. The bushings 80*a*, 80*b* have a first outer diameter 82*a*, 82*b* and a second larger outer diameter 84*a*, 84*b*. The guide pins 40,42 are disposed through a bore in the bushings 80*a*, 80*b*.

Figure 11:
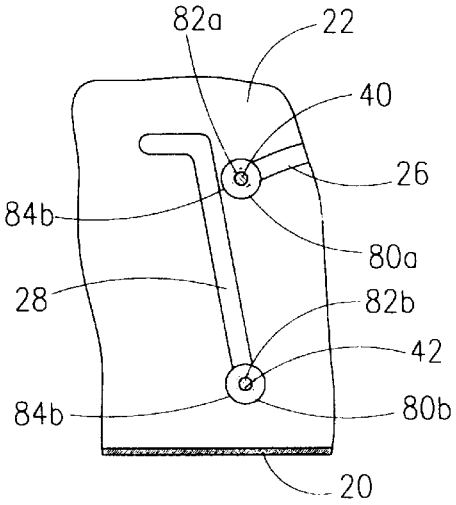
FIG. 11 is a side view of the guide wall, guide pins, and bushings taken along line 11—11 of FIG. 10.

As seen in FIG. 11, which is a side view of the guide wall 22, guide pins 40,42 and bushings 80*a*, 80*b* taken along line 11—11 of FIG. 11, the outer diameter 82*a* will fit into and cooperate within the slot 26, while the outer diameter 82*b* will fit into and cooperate within the slot 28. By having the outer diameter 82*a*, 82*b* of the bushings being slidably disposed within the slots 26,28, the novel design serves to reduce friction. Also, the Teflon material acts to lubricate. In fact, no "oil" is required since the sea, gulf, lake and/or ocean water will provide enough lubrication. This offers an advantage over the prior art since oils can be hazardous and/or polluting.

Having described the presently preferred exemplary embodiment of a convertible seat and deck apparatus in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A convertible seat and deck apparatus comprising:

a frame, said frame having a first guide wall, said first guide wall having a first elongated slot and a second elongated slot, and wherein said first elongated slot is curvilinear, said second elongated slot has a first linear portion and a second linear portion that is disposed at a predetermined angle with respect to said first linear portion, and said predetermined angle is approximately 100 degrees;

a seat back having a first seating surface, an opposite second deck surface and a first side, a first guide pin projecting from said first side, a second guide pin projecting from said first side, said first guide pin being slidably received in said first elongated slot, said second guide pin being slidably received in said second elongated slot, said seat back being movable with respect to said frame between a first seating position and a second deck position.

2. The convertible seat and deck apparatus according to claim 1, further comprising a deck having a first surface, said deck being fixedly connected to said frame, in said second deck position, said second deck surface of said seat back being adjacent to and approximately coplanar with respect to said first surface of said deck.

3. The convertible seat and deck apparatus according to claims 2, wherein said second linear portion has a length sufficient to permit said seat back to move away from said deck so that said seat back is moveable to said first seating position without interfering with said deck.

4. The convertible seat and deck apparatus according to claim 3, wherein said seat back is, at least partly, pivotable to said first seating position.

5. The convertible seat and deck apparatus according to claim 2, further comprising a seat base connected to said frame, in said first seating position, said seat base being disposed adjacent to and at an angle with respect to said seat back, in said second deck position, said seat base being disposed spaced from and approximately parallel to said seat back.

6. A convertible seat and deck apparatus comprising:

a frame, said frame having a first guide wall and a second guide wall, said first guide wall having a first elongated slot and a second elongated slot, said second guide wall having a third elongated slot and a fourth elongated slot, and wherein said first and third elongated slots are curvilinear, and wherein said second and fourth elongated slots each have a first linear portion and a second linear portion, and wherein said second linear portion is disposed at an angle of approximately 100 degrees with respect to said first linear portion;

a seat back having a first seating surface, an opposite second deck surface, a first side and a second side, a first guide pin and a second guide pin projecting from said first side, a third guide pin and a fourth guide pin projecting from said second side, said seat back being moveable with respect to said frame between a first seating position and a second deck position.

7. The convertible seat and deck apparatus according to claim 6, further comprising a deck having a first surface, said deck being fixedly connected to said frame, in said second deck position, said second deck surface of said seat back being adjacent to and approximately coplanar with respect to said first surface of said deck.

8. The convertible seat and deck apparatus according to claim 7, wherein said second linear portion has a length sufficient to permit said seat back to move away from said deck so that said seat back is moveable to said first seating position without interfering with said deck.

9. The convertible seat and deck apparatus according to claim 8, wherein said seat back is, at least partly, pivotable to said first seating position.

10. The convertible seat and deck apparatus according to claim 6, further comprising a seat base connected to said frame, in said first seating position, said seat base being disposed adjacent to and at an angle with respect to said seat back, in said second deck position, said seat base being disposed spaced from and approximately parallel to said seat back.

11. a convertible seat and deck apparatus comprising:

a frame, said frame having a first guide wall, said first guide wall having a first elongated slot and a second elongated slot, and wherein said first elongated slot is curvilinear, wherein said second elongated slot has a first linear portion and a second linear portion that is disposed at a predetermined angle with respect to said first linear portion;

a seat back having a first seating surface, an opposite second deck surface and a first side, a first guide pin projecting from said first side, a second guide pin projecting from said first side, said first guide pin being slidably received in said first elongated slot, said second guide pin being slidably received in said second elongated slot, said seat back being movable with respect to said frame between a first seating position and a second deck position;

and wherein said first elongated slot has an essentially linear portion, and wherein said second linear portion is approximately parallel to said essentially linear portion.

12. A convertible seat and deck apparatus comprising:

a frame having a first guide wall and a second guide wall, said first guide wall having a first elongated slot and a second elongated slot, said second guide wall having a third elongated slot and a fourth elongated slot and wherein said first and third elongated slots are curvilinear, wherein said second and fourth elongated slots each have a first linear portion and a second linear portion that are disposed at a predetermined angle with respect to said first linear portion, and wherein said first elongated slot has an essentially linear portion, said second linear portion is approximately parallel to said essentially linear portion; and, a seat back having a first seating surface, an opposite second deck surface, a first side and a second side, a first guide pin and a second guide pin projecting from said first side, a third guide pin and a fourth guide pin projecting from said second side, said seat back being moveable with respect to said frame between an first seating position and a second deck position.

13. A convertible seat and deck apparatus comprising:

a frame having a first guide wall and a second guide wall, said first guide wall having a first elongated slot and a second elongated slot, said second guide wall having a third elongated slot and a fourth elongated slot and wherein said first and third elongated slots are curvilinear, wherein said second and fourth elongated slots each have a first linear portion and a second linear portion that are disposed at a predetermined angle with respect to said first linear portion;

a seat back having a first seating surface, an opposite second deck surface, a first side and a second side, a first guide pin and a second guide pin projecting from said first side, a third guide pin and a fourth guide pin projecting from said second side, said seat back being moveable with respect to said frame between and first seating position and a second deck position;

a hook member having a lever attached thereto, said hook member being pivotally attached to said first guide wall and configured t engage said first guide pin.

* * * * *